US007451894B2

(12) United States Patent
Ophardt

(10) Patent No.: US 7,451,894 B2
(45) Date of Patent: Nov. 18, 2008

(54) DISPENSER WITH THUMBPRINT READER

(75) Inventor: Heiner Ophardt, Vineland (CA)

(73) Assignee: Hygiene-Technik Inc., Beamsville, Ontario (CA)

( * ) Notice: Subject to any disclaimer, the term of this patent is extended or adjusted under 35 U.S.C. 154(b) by 543 days.

(21) Appl. No.: 11/085,066

(22) Filed: Mar. 22, 2005

(65) Prior Publication Data

US 2006/0213924 A1 Sep. 28, 2006

(30) Foreign Application Priority Data

Feb. 9, 2005 (CA) ..... 2496418

(51) Int. Cl.
*B67D 5/08* (2006.01)
*E03C 1/05* (2006.01)

(52) U.S. Cl. ..... 222/52; 222/181.3; 222/63; 4/623

(58) Field of Classification Search ..... 222/180, 222/181.1, 181.2, 181.3, 333, 63, 52; 4/623, 4/628; 250/338.1, 455.11; 422/22, 24; 235/380, 235/382; 382/124
See application file for complete search history.

(56) References Cited

U.S. PATENT DOCUMENTS 3,419,188 A * 12/1968 Matchett ..... 222/52
3,576,277 A * 4/1971 Blackman ..... 222/1
4,722,372 A * 2/1988 Hoffman et al. ..... 141/98
4,967,935 A 11/1990 Celeste
5,487,877 A * 1/1996 Choi ..... 422/300
5,836,482 A 11/1998 Ophardt
5,960,991 A * 10/1999 Ophardt ..... 222/1
6,206,238 B1 3/2001 Ophardt
6,209,751 B1 * 4/2001 Goodin et al. ..... 222/52
6,278,122 B1 * 8/2001 Gagnon ..... 250/455.11
6,382,467 B2 * 5/2002 Saveliev et al. ..... 222/148
6,390,329 B1 * 5/2002 Maddox ..... 222/25
6,404,837 B1 6/2002 Thompson
6,698,616 B2 * 3/2004 Hidle et al. ..... 222/1
6,707,873 B2 3/2004 Thompson
6,720,950 B2 * 4/2004 Cheng ..... 345/163
7,227,534 B2 * 6/2007 Lin et al. ..... 345/163

FOREIGN PATENT DOCUMENTS

WO WO 99/00043 A 1/1999
WO WO 02/094073 A1 11/2002

* cited by examiner

*Primary Examiner*—Kevin P. Shaver
*Assistant Examiner*—Stephanie E Tyler
(74) *Attorney, Agent, or Firm*—Riches, McKenzie & Herbert LLP

(57) ABSTRACT

A fingerprint reader for a thumb disposed above an outlet for fluid and adapted to be engaged by an inside surface of a user's thumb extending upwardly relative to the palm of a user's hand while the user's hand extends generally horizontally forwardly from the thumb directed upwardly to receive fluid dispensed downwardly thereon to from a fluid dispensing outlet while the thumb engages the fingerprint reader.

23 Claims, 5 Drawing Sheets

DISPENSER WITH THUMBPRINT READER

SCOPE OF THE INVENTION

This invention relates to dispensers for dispensing material onto a user's hand and, more particularly, to automated dispensers of hand cleaner which permit monitoring of use.

BACKGROUND OF THE INVENTION

Dispensers are known as taught in the applicant's U.S. Pat. No. 5,960,991 to Ophardt, issued Oct. 5, 1999 and U.S. Pat. No. 6,206,238 to Ophardt, issued Mar. 27, 2001 which provide on an under surface of a dispenser a fingerprint reader for engagement by a finger of a user's hand while the user's hand is ready to receive fluid to be dispensed. The present applicant has appreciated that such dispensers suffer the disadvantage is that the fingerprint reader is out of the view of a user rendering it difficult for a user to appreciate where to locate a finger to be read by the reader and difficult to intuitively understand how to use the dispenser.

SUMMARY OF THE INVENTION

To at least partially overcome these disadvantageous of previously known devices, the present invention provides a fingerprint reader for a thumb at a location on a dispenser visually apparent to a user for easy engagement preferably with the fingerprint reader directed forwardly.

An object of this invention is to provide an improved dispenser with fingerprint reading capability.

In one aspect, the present invention provides a dispenser with a fingerprint reader for a thumb disposed above an outlet for fluid and adapted to be engaged by an inside surface of a user's thumb extending upwardly relative to the palm of a user's hand while the user's hand extends generally horizontally forwardly from the thumb directed upwardly to receive fluid dispensed downwardly thereon to from a fluid dispensing outlet while the thumb engages the fingerprint reader.

In another aspect, the present invention provides a dispenser comprising an outlet disposed to dispense fluid downwardly onto an upwardly directed palm of a user's hand, and a fingerprint reader located relative to the outlet at a position permitting easy engagement of the fingerprint reader by a thumb of the hand extending upwardly.

In another aspect, the present invention provides a method of dispensing material onto a person's hand comprising:

placing a user's hand such that an upwardly directed palm of the user's hand is disposed under a fluid outlet from which fluid is to be dispensed, placing a thumb of the user's hand to extend upwardly from the palm such that an inside surface of the thumb to be read is on or proximate a first sensor located relative the outlet at a height above a height at which the outlet is located, sensing with the first sensor that the thumb of the user is placed on or proximate the fingerprint user, sensing with a second sensor that the palm of a user's hand is underneath the outlet, after sensing with the first sensor that the thumb is proximate the first sensor and sensing with the second sensor that the palm of the hand is underneath the outlet, dispensing material from the outlet for a period of time in a manner that the material engages the palm of the user's hand underneath the outlet.

In another aspect, the present invention provides a dispenser having an outer housing with a forward surface extending upwardly from a leading lower edge and a lower surface extending downwardly and rearwardly from the leading lower edge, an outlet on the lower surface disposed to direct fluid downwardly onto an upwardly directed palm of a user's hand placed below the lower surface;

a first sensor located on the upper surface relative the outlet at a position permitting sensing of a thumb of the user's hand extending upwardly from the palm, a dispensing mechanism to dispense material from the outlet when the dispensing mechanism is activated, a control mechanism to activate the dispensing mechanism to dispense fluid when the first sensor senses the thumb.

In another aspect, the present invention provides a dispenser having an activation mechanism wherein engagement of an engagement surface with a user's hand activates the dispenser, a disinfectant mechanism to disinfect the engagement surface comprising a radiation emitter to emit radiation to impinge on organisms on the engagement surface sufficient to kill such organisms. Preferably, the engagement surface comprises a surface of a member capable of transmitting the radiation internally there through with transmission losses being substantially less than transmission losses through air; and with the radiation being transmitted internally to the member from an emitter along an optic pathway which has transmission losses substantially less than transmission losses through air with the radiation to exit the substantial entirety of the engagement surface.

BRIEF DESCRIPTION OF THE DRAWINGS

Further aspects and advantageous of the present invention will become apparent from the following description taken together with the accompanying drawings in which.

DETAILED DESCRIPTION OF THE DRAWINGS

Figure 1:
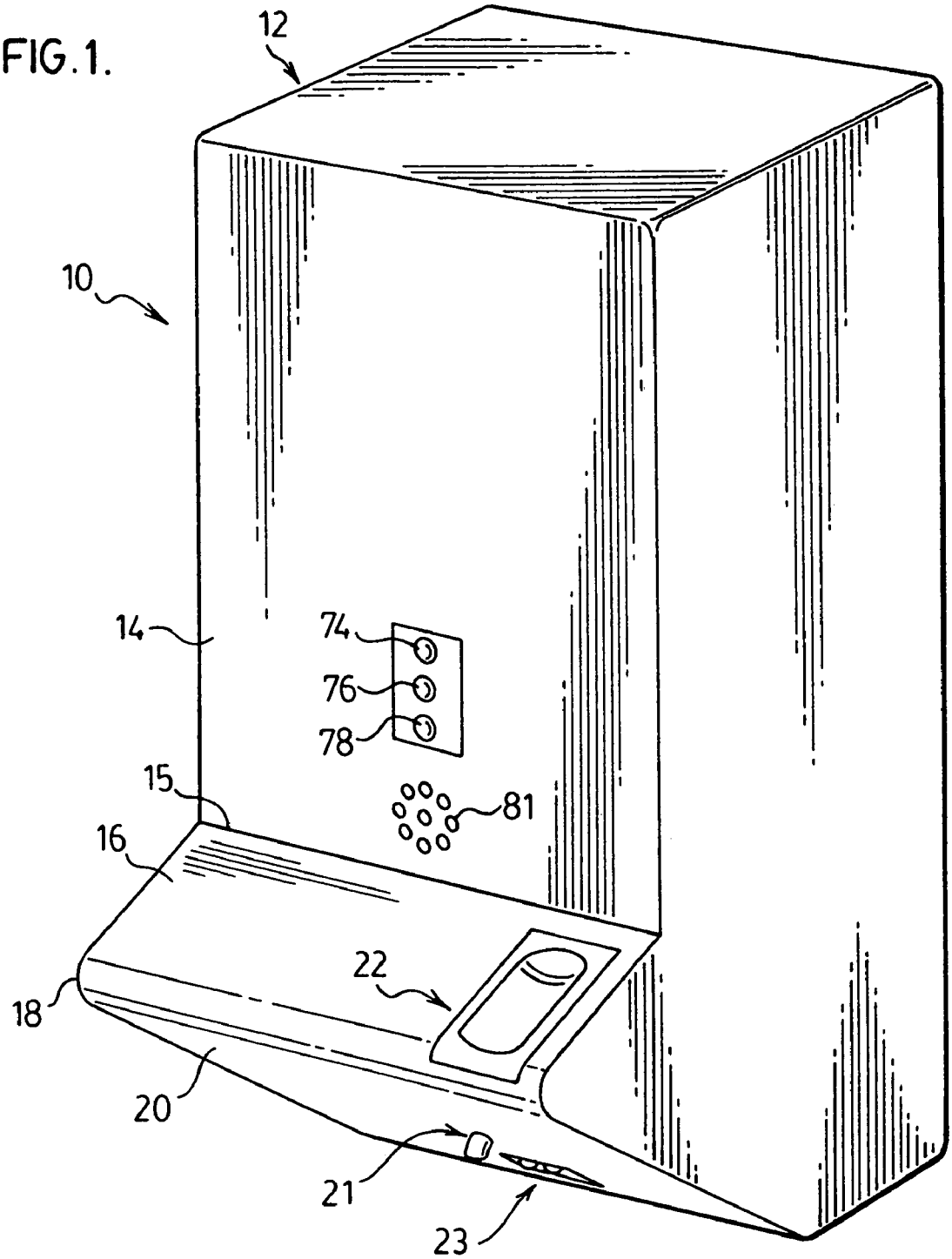
FIG. 1 is a pictorial view of a dispenser in accordance with the first embodiment of the present invention.
Figure 2:
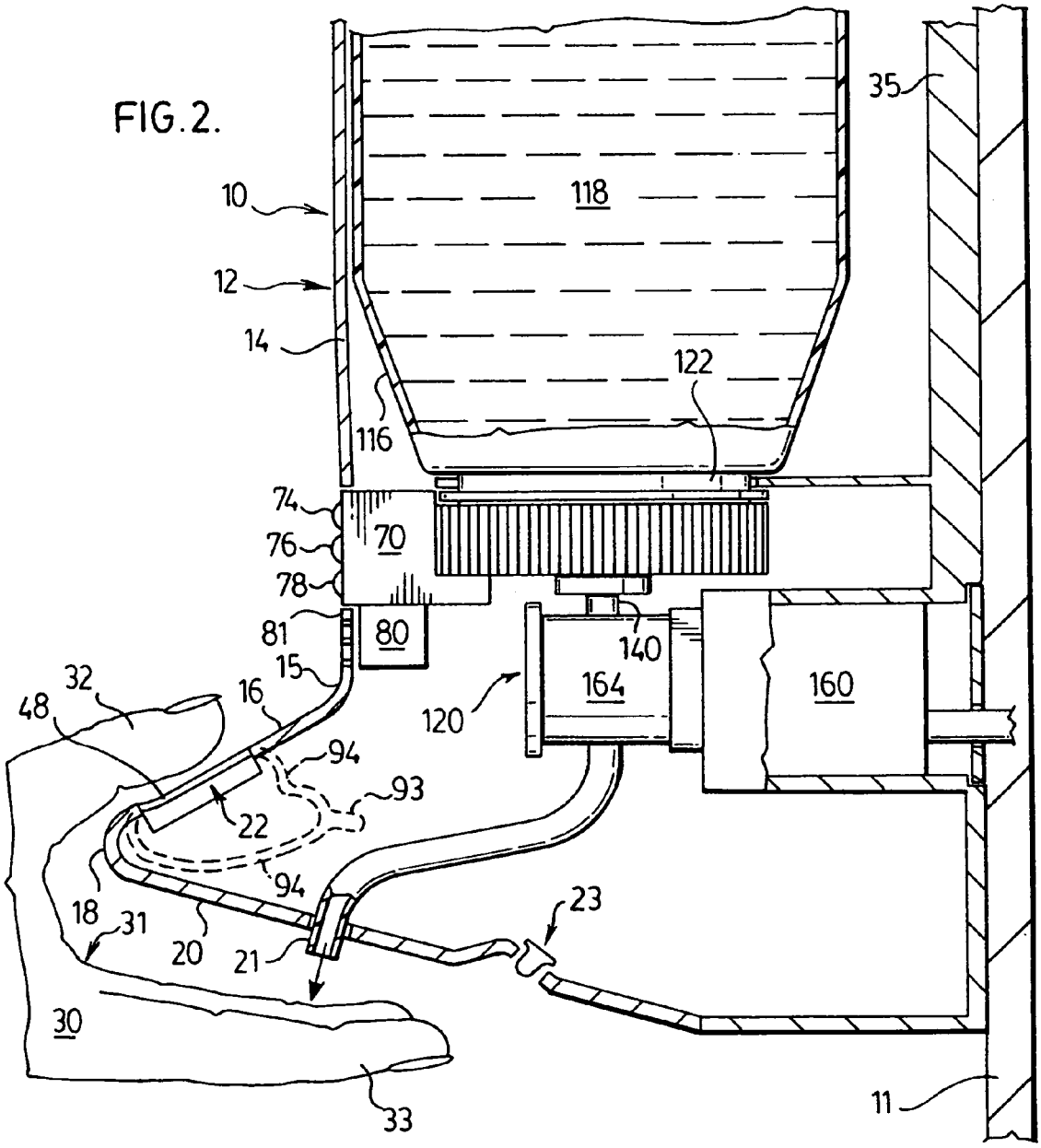
FIG. 2 is a schematic partially cross-sectional side view of the dispenser of FIG. 1 showing a person's hand disposed thereto.
Figure 3:
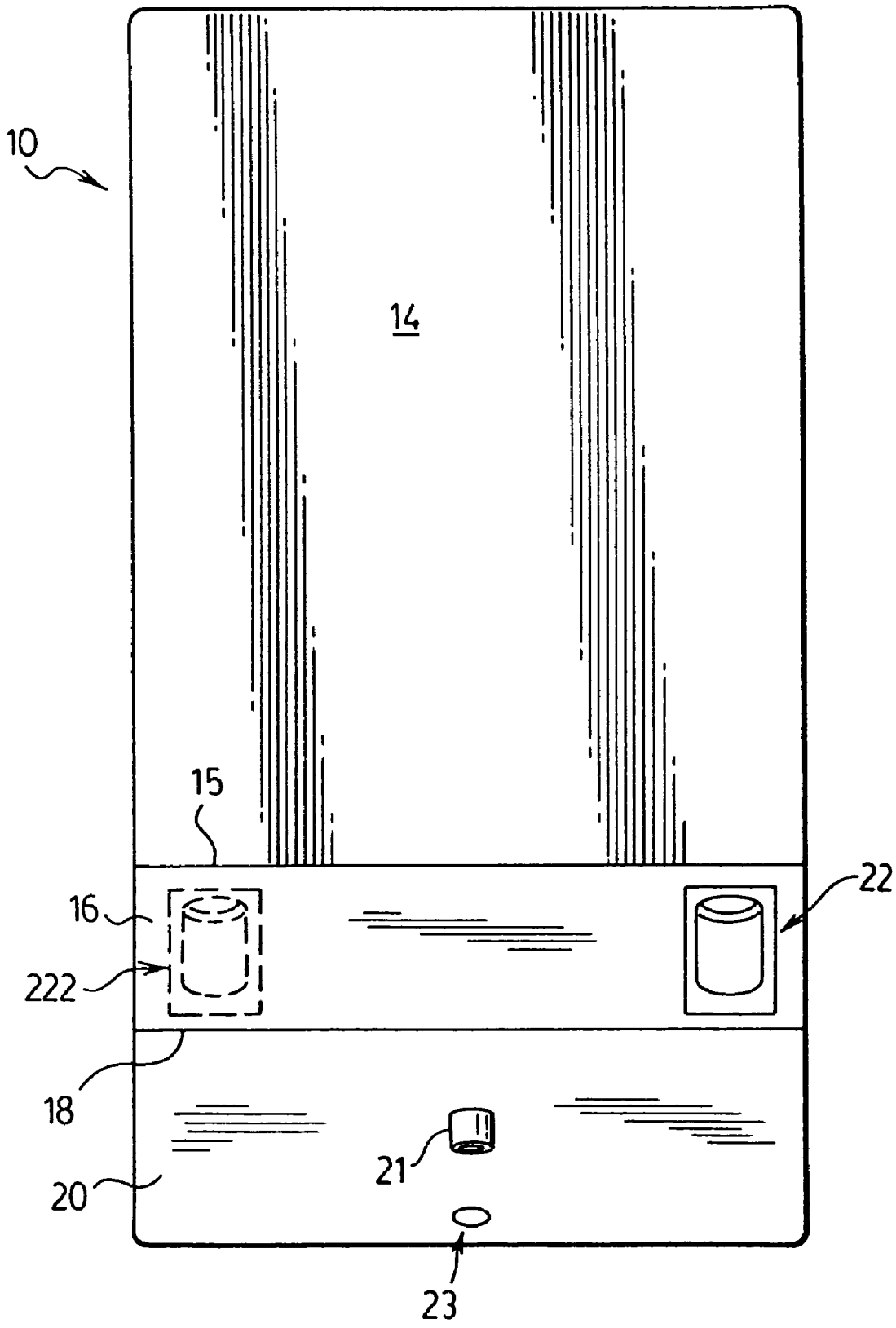
FIG. 3 is a front view of the dispenser of FIG. 1.

Reference is made to FIGS. 1 to 3 which show a first embodiment of dispenser 10 in accordance with the invention. The dispenser 10 is shown is FIG. 2 schematically as mounted to a wall 11. The dispenser 10 has a housing 12 projecting forwardly from the wall 11. The housing 12 has a front face formed by a generally vertical upper front panel 14 and an inclined lower front panel 16. As seen, from a lower edge 15 of the upper front panel 14, the lower front panel 16 extends at an angle forwardly and downwardly to a forward edge 18. A bottom panel 20 extends rearwardly and downwardly from the forward edge 18.

A first sensor 22 is provided on the lower front panel 16. A second sensor 23 is provided on the bottom panel 20 to sense the presence of a user's hand underneath an outlet tube 21.

The outlet tube 21 extends downwardly through the bottom panel 20 generally centrally between its sides as seen in FIG. 3. The outlet tube 21 is connected to a dispensing mechanism activable to dispense fluid from the outlet tube 21 by a suitable control mechanism receiving input from the first sensor 22 and the second sensor 23.

FIG. 2 illustrates use of the dispenser by a user's right hand 30 being disposed with the thumb 32 engaging the first sensor 22 and the palm 31 and fingers 33 located under the outlet tube 21 and the bottom panel 20 to be sensed by the second sensor 23. As seen, the palm 31 is disposed to open upwardly and the fingers 33 are disposed to extend rearwardly from the palm 31 such that the palm 31 and fingers 33 are ready to receive fluid to be dispensed by the outlet tube 21. The palm and fingers are shown to be disposed generally horizontally.

The thumb 32 extends upwardly from the palm 31 to overlie the first sensor 22.

A user who is in front of the dispenser 10 can readily see the first sensor 22 and visually guide his thumb 32 into engagement with the sensor 22. The dispenser 10 is preferably disposed at a height that a user can simultaneously see both the first sensor 22 and the outlet tube 21 so as to assist the user in locating his upwardly facing palm 31 underneath the outlet tube 21 at the same time that he locates his thumb on the first sensor 22.

Each the first sensor 22 and the second sensor 23 may be merely sensors which sense the present of an object. Preferred sensors include proximity sensors which sense the pressure of an object, pressure sensors sensitive to pressure or touch, infrared sensors, thermal sensors which will sense the heat from a user's hand, motion sensors which will sense motion of a person's hand and thermal detection sensors which will sense reflected signals from signal emitting source provided on the dispenser. Various different sensors may be provided as the first sensor 22 or the second sensor 23. The first sensor 22 in the preferred embodiment is a fingerprint reader preferably adapted for reading a fingerprint by engagement of the fingerprint reader with the thumb 32 of a user, preferably by engagement with inside surfaces of the thumb or for reading a fingerprint as with a thumb located proximate to but spaced from the reader. The first sensor 22 may not only have the capability of reading a fingerprint but may additionally have the capability as acting as a sensor which senses whether a thumb is located on or proximate the sensor 22 such as a pressure sensor or proximity sensor to sense the presence of an object, i.e. a thumb, is located in a desired proximity relative to the reader whether or not a thumbprint is actually read. The first sensor 22 may comprise merely a pressure sensor or a proximity sensor without fingerprint reading abilities. The second sensor 23 preferably comprises an infrared light emitting diode to transmit a pulse of infrared light at predetermined intervals downwardly from the housing and with the second sensor 23 also including a corresponding photo receiver to receive and sense light reflected off a user's hand placed beneath the dispenser. Such a system is for example described in U.S. Pat. No. 4,967,935 to Celeste issued Nov. 6, 1990.

FIG. 2 is a schematic cross-sectional side view of the dispenser of FIG. 1 showing internal workings of a dispensing mechanism as taught by U.S. Pat. Nos. 5,836,482 and 6,206,238 the disclosures of which are incorporated herein by reference. As shown, the dispenser 10 includes the housing 12 and a wall mount 35 is adapted to be mounted vertically as to wall 11. The housing 12 is adapted to be coupled to the wall mount 35 to permit insertion and removal of a dispensing mechanism preferably comprising a fluid container 116 and a pump 120. The container 116 is filled with fluid 118. The container 116 has a cylindrical outlet neck 122 which is externally threaded at its end to receive a cap 124. The cap 124 opens into a feed tube 140. Fluid is conducted via the feed tube 140 to the pump 120 which is operative to dispense fluid through the outlet tube 21. A motor 160 is mounted on the wall mount 35 to carry a forwardly open socket 164 to removably receive the pump 120.

A control mechanism (not shown) is provided to control operation of the dispenser. The control mechanism includes a fingerprint reader as the first sensor 22 having a reader bed 48 on which the inside surface of the thumb 32 whose print is to be read is to be placed.

The control mechanism also includes the second sensor 23, preferably as a proximity sensor which will sense the presence of the user's hand 30 under the outlet tube 21.

The sensors 22 and 23 are useful for assisting the control mechanism and providing instructions to a user to locate his hand including the palm and thumb in the appropriate position relative to the dispenser. The sensors 22 and 23 are useful to provide with the control mechanism instructions to a user to hold his palm under the outlet or to place his thumb on the reader and to measure the time that the thumb may be proximate on or the reader 22 or that the palm 31 may be underneath the outlet tube 21. After initial reading, the sensors are useful to positively ensure that during the period of time that materials are dispensed, that the materials dispensed will necessarily engage the user's palm 31 because the user's palm 31 or its fingers 33 are sensed to be in a desired location under of the outlet tube 21.

The dispensing mechanism can be operated using only the second sensor 23 merely to sense the proximity of the user's palm 31 within a desired proximity of the outlet tube 21. Preferably however the dispensing mechanism is controlled by the control mechanism in a manner that for dispensing to occur, the palm 31 of a user's hand must be sensed by the second sensor 23 underneath the outlet 21 and there must be at least some sensing of the location of the thumb on or proximate the thumb reader as by the first sensor 22. More preferably, the first sensor 22 either reads a thumbprint or senses a location of a thumb for dispensing to occur.

A signal mechanism is preferably provided to provide signals and feedback to a person using the dispenser 10. In FIG. 2 visual indicator 70 is secured to the wall mount 35 and presents an array of three signal lamps 74, 76 and 78 visible through a window in the housing 12. The signal lamps 74, 76 and 78 can provide various signals to a user and preferably are capable of being unlit and showing different colors such as green, yellow or red. Written instructions may be provided adjacent the signals to assist the user in interpreting the lamps signals.

FIG. 2 also shows an audible signal device or a loud speaker 80 to pass audio signals such as pre-recorded language signals and music notes, tones, buzzers and alarms to a user through openings 81 in the housing 12. Other signal information such as an LED screen (not shown) to carry changeable text messages may be provided.

Reference is made to FIG. 3 which illustrates a front view of the dispenser 10 of FIG. 1 notably showing that the first sensor 22 is spaced to the right relative the outlet tube 21 as is of assistance to ensure that fluid is dispensed on to a user's palm which is located to the right of the thumb of an upturned right hand of the user. FIG. 3 illustrates in dashed lines a secondary first sensor 222 spaced to the left relative the outlet tube 21 and adapted to be engaged by a thumb of a user's upturned left hand. The dispenser 10 may provide merely one of the first sensors 22 and 222 for merely right or left hand activation or may provide both first sensors 22 and 222 to have capability of activation with either right or left hand.

The preferred embodiment is illustrated with fluid to be dispensed out a single outlet tube 21. It is preferred there only be a single outlet tube 21 whether or not there may be only a left or right thumbprint reader 22 and 222. Of course, a plurality of outlet tubes 21 may be provided if for example a number of different fluids may be desired to be dispensed without premixing, or one for right hand dispensing and one for left hand dispensing.

Figure 4:
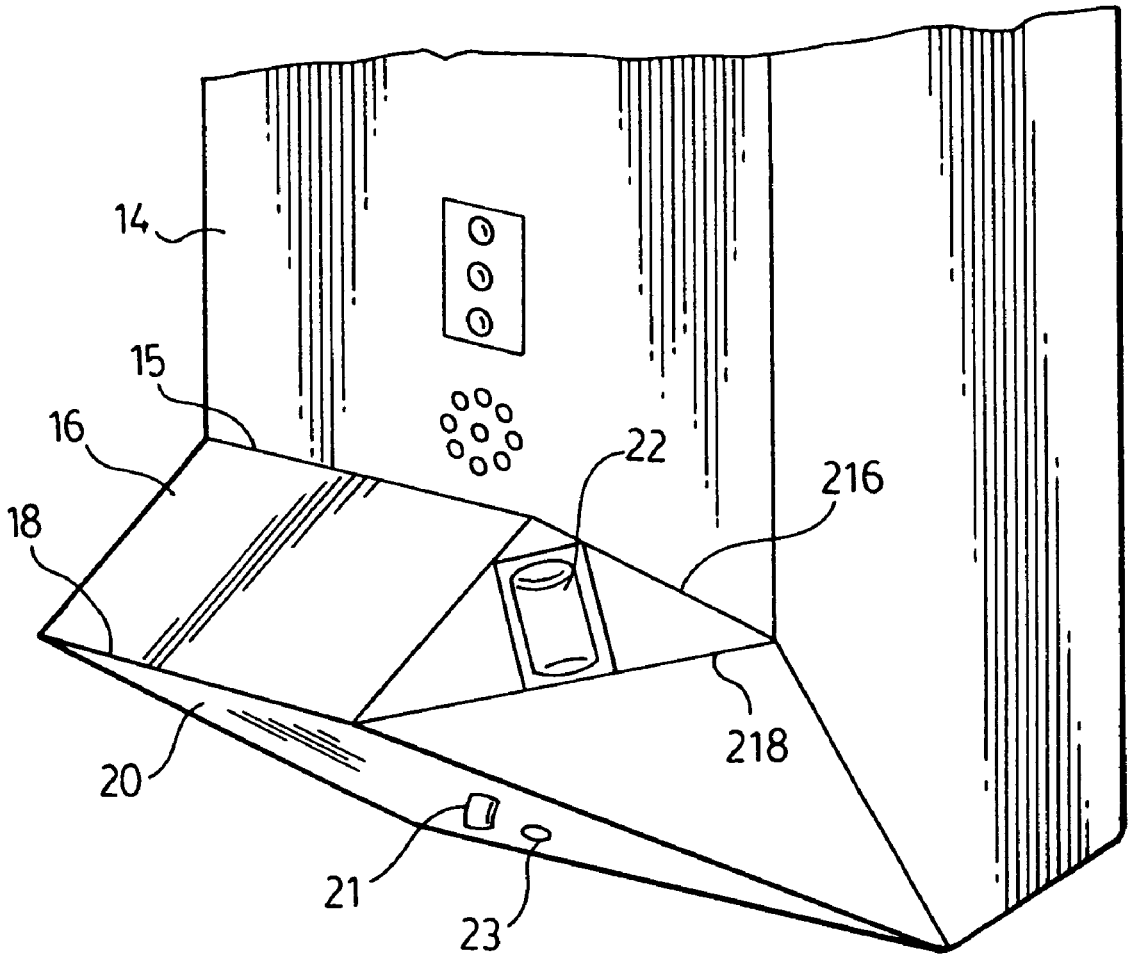
FIG. 4 is a pictorial view of a dispenser in accordance with a second embodiment of the present invention.

Reference is made to FIG. 4 which illustrates a second embodiment of the invention similar to that in FIG. 1 however in which the first sensor 22 is adapted for reading of the thumb of a right hand of a user and is directed forwardly and towards to the right side of the housing. As seen the front panel 16 has at its right side a right side portion 216 which is angled towards the rights as well as upwardly and forwardly. This portion 216 carries the sensor 22 between angled extension 215 of the lower edge 15 and angled extension 218 of forward edge 18. This relative angulation of the first sensor 22 towards the right side can be of assistance for engagement by a thumb with the fingers pointed generally forwardly. In FIG. 4 the fingerprint reader and the inclined front panel 216 carrying it are directed upwardly, forwardly and towards the right. Thus it is to be appreciated that the fingerprint reader and/or sensor 21 need not be directed merely forwardly and upwardly.

Figure 5:
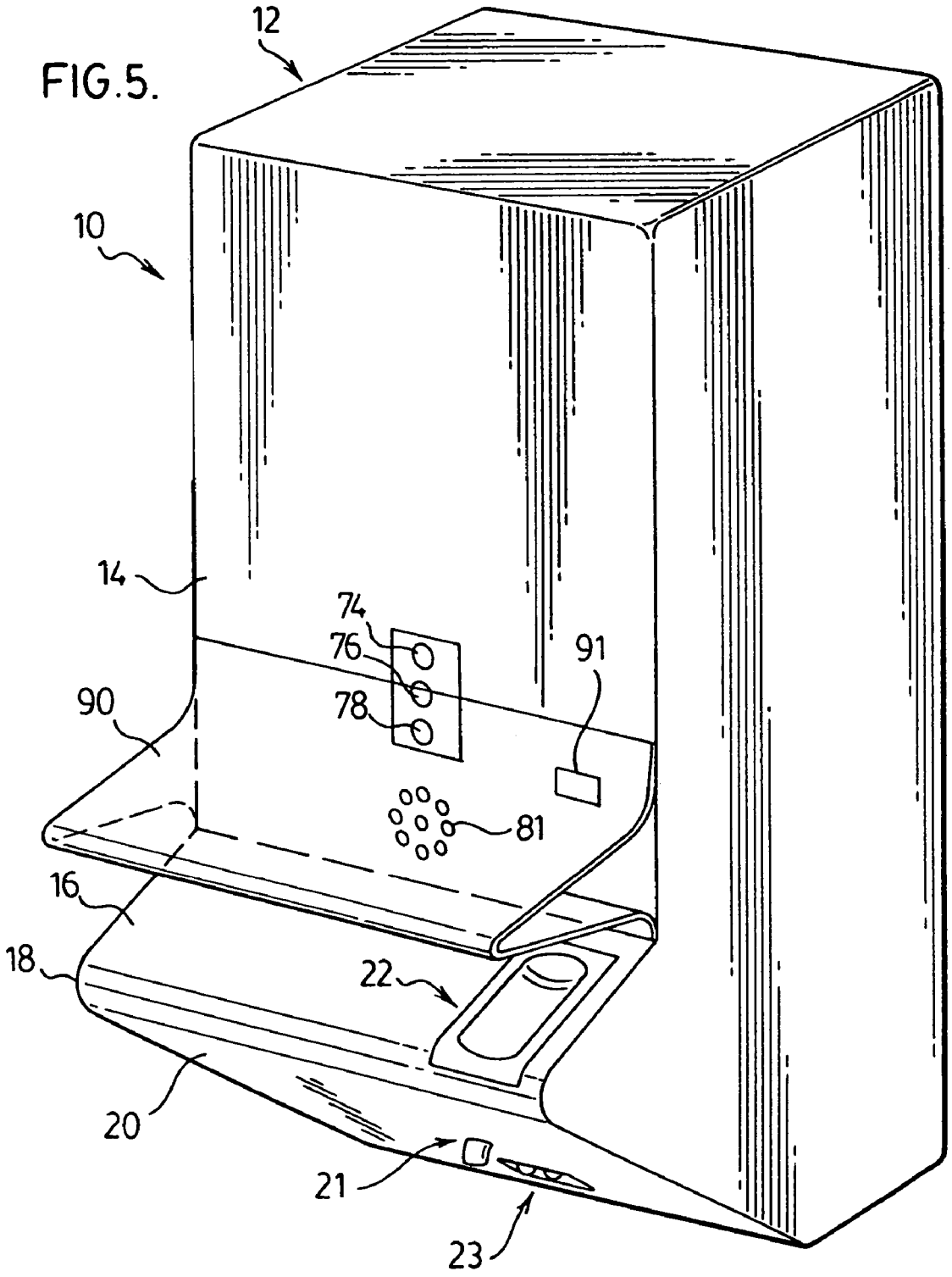
FIG. 5 is a pictorial view of a dispenser in accordance with a third embodiment of the present invention.

Reference is made to FIG. 5 which shows a pictorial view of a dispenser substantially identical to that show in FIG. 1 but including a transparent shield 90 which extends outwardly from the upper front panel 14 spaced above the lower front panel 16 such that there is a vertical gap 91 a sufficient height to permit a user to insert their thumb between the shield 90 and the lower front panel 16 and place their thumb on the sensor 22. A disinfecting radiation emitter 91 is provided on the upper front panel 14 under the shield 90 to emit radiation downward onto at least the sensor 22 to disinfect the sensor 22. Preferred radiation to be emitted by emitter 92 is ultraviolet radiation of sufficient intensity to kill microorganisms, germs and viruses on and proximate the sensor 22. As shown the emitter 92 sends radiation downwardly onto the sensor 21 and lower front panel 16 thereon. The disinfection radiation emitter may be operated continuous or more preferably intermittently sending radiation sufficient to disinfect the sensor 22 after each contact with the sensor 22.

As an alternate arrangement the sensor 22 may be backlit by an emitter such that UV radiation passes from the back and/or sides of a readerbed 48 or sensor 22 which preferably is light transmitting and onto the entire surface of the readerbed 48 or sensor 22 which is contacted by a user. As schematically shown in FIG. 2 the sensor 22 or reader bed 48 may be configured to act as a light guide to internally direct light from an emitter to exit over the entire surface of the reader bed 48 surface which is to be engaged by a user. Thus, the sensor 22 may have a reader plate 48 which transmits light which may be delivered as for example via an optic fibers 94 shown in dashed lines in FIG. 2 from an emitter 93 also shown in dashed lines in FIG. 2 such that the ultraviolet radiation merely passes through optically conductive pathways before exiting through the surface of the reader plate 48 and onto organisms thereon. This permits much lower energy levels to be used than in the situation where the radiation must first pass through air before it engages organisms to be killed. Various reflective/refractive techniques may be used to ensure the radiation preferably ultraviolet light exits through the entire surface of the reader bed 48 or sensor 22 to be engaged with adequate radiation levels throughout for disinfecting. With the optical characteristics of the reader bed 48 and optical fibers 94 having radiation transmission losses which are substantially less than radiation transmission losses passing through air, reduced radiation levels can provide adequate killing of microorganisms.

The use of such internally transmitted radiation to disinfect is not limited it fingerprint readers or touch sensors but may be used in other applications such as on a soap dispenser activator lever formed a U-shape from a tube. If the tube is selected to be light transmitting material such as glass or plastic or a combination, with light emission along its length then by optic coupling with an emitter light emission internally through the tube can disinfect the activator over its length. A plurality of optic fibers could be connected to a light transmitting contact plate at a plurality of locations so as to be sure that the radiation exits over an entire surface of a plate to be disinfected. Such internally transmitted radiation to disinfect can be used in any manner of applications to disinfect surfaces which may be contacted including, for example, door handles, water fountain spouts, feed troughs for animals, weigh scales, hand readers, door activation switches, push plates on doors and handles of food serving utensils. Virtually any surface which may need to be contacted by hand, foot or mouth could be disinfected in this manner. If the radiation to pass through the surface might be harmful to whatever is contacting the surface, for example, a hand, then the disinfecting radiation may be applied only after contact and for a limited period of time. Continuous or intermittent radiation may be used.

While the invention has been described with reference to preferred embodiments, many modifications and variations will now occur to persons skilled in the art. For a definition of the invention, reference is made to the following claims.

I claim:

1. A dispenser comprising:

an outlet disposed to dispense fluid downwardly onto an upwardly directed palm of a user's hand, a fingerprint reader located relative to the outlet at a position permitting easy engagement of the fingerprint reader by a thumb of the hand extending upwardly relative its upwardly directed palm, the fingerprint reader located at a height above the height of which the outlet is located, the dispenser having an outer housing with a forward surface extending upwardly from a lower edge and a lower surface extending downwardly and rearwardly from the lower edge, the fingerprint reader provided on the forward surface, the outlet directing fluid downwardly relative the lower surface.

2. A dispenser as claimed in claim 1 wherein the forward surface extends upwardly and rearwardly from the lower edge.

3. A dispenser as claimed in claim 2 wherein the fingerprint reader is mounted on the forward surface spaced from the lower edge.

4. A dispenser as claimed in claim 1 including a palm sensor to sense whether the palm of a user's hand is underneath the outlet within a desired proximity of the outlet.

5. A dispenser as claimed in claim 1 including a dispensing mechanism to dispense material from the outlet when the dispensing mechanism is activated, a control mechanism to activate the dispensing mechanism to dispense material from the outlet, a palm sensing mechanism to sense whether a user's palm is underneath the outlet within a desired proximity to the outlet, the control mechanism activating the dispensing mechanism to initiate dispensing of material after the palm sensing mechanism has sensed the location of a user's palm within the desired proximity of the outlet.

6. A dispenser as claimed in claim 5 wherein the control mechanism requires as a prerequisite to activate dispensing both the palm sensing mechanism sensing the location of a user's palm within the desired proximity of the outlet and the fingerprint reader sensing that a user's thumb is proximate the fingerprint reader.

7. A dispenser as claimed in claim 1 including a dispensing mechanism to dispense material from the outlet when the dispensing mechanism is activated, the fingerprint reader having a finger bed, the reader adapted to read a fingerprint of a user's thumb when located on or proximate to the bed, a thumb sensing mechanism to sense the location of a thumb on or relative to the bed, a control system to activate the dispensing mechanism to dispense fluid after the thumb sensing mechanism has sensed the location of a thumb on or proximate the bed.

8. A dispenser as claimed in claim 7 including a palm sensor to sense whether the palm of a user's hand is within a desired proximity to the outlet.

9. A dispenser as claimed in claim 8 wherein the control means activates the dispensing mechanism to initiate dispensing of fluid after the palm sensor has sensed the location of a user's palm within the desired proximity to the outlet simultaneously with the thumb sensing mechanism sensing a thumb on or proximate to the bed.

10. A dispenser as claimed in claim 2 wherein the fingerprint reader having a finger bed is directed forwardly, upwardly and toward one side.

11. A dispenser as claimed in claim 1 including a pair of fingerprint readers, a right side fingerprint reader disposed in a right side of the outlet to receive a thumb of a right hand of a user and a left hand fingerprint reader disposed on a left side of the outlet to receive a thumb of a left hand of the fingerprint reader.

12. A dispenser as claimed in claim 11 including a single outlet located intermediate the right fingerprint reader and the left fingerprint reader.

13. A dispenser as claimed in claim 1 wherein with the upwardly directed palm of a user's hand located under the outlet with the fingers of the hand extending generally horizontally towards their distal ends in a rearward direction, the outlet is adapted to dispense fluid generally downwardly on to the upwardly directed palm and the fingerprint reader is located relative to the outlet at a position facilitating engagement of the fingerprint reader by an insider surface of the thumb extending upwardly from the palm.

14. A dispenser as claimed in claim 3 wherein the fingerprint reader and the outlet are capable of both been seen simultaneously by a user in front of the dispenser.

15. A dispenser as claimed in claim 1 including a recording mechanism to maintain a record of the fingerprint read.

16. A dispenser as claimed in claim 1 including a signal mechanism to signal visually or audibly to a user that a fingerprint from the user's thumb has been read.

17. A dispenser as claimed in claim 4 including a palm location signal mechanism to signal to the user that a user's palm is sensed by the palm sensor as being underneath the outlet within a desired proximity of the outlet.

18. A method dispensing material onto a person's hand comprising:

placing a user's hand such that an upwardly directed palm of the user's hand is disposed under a fluid outlet from which fluid is to be dispensed, placing a thumb of the user's hand to extend upwardly from the palm such that an inside surface of the thumb to be read is on or proximate a first sensor located relative the outlet at a height above a height at which the outlet is located, sensing with the first sensor that the thumb of the user is placed on or proximate the first sensor, sensing with a second sensor that the palm of the user's hand is underneath the outlet, after sensing with the first sensor that the thumb is proximate the first sensor and sensing with the second sensor that the palm of the hand is underneath the outlet, dispensing material from the outlet for a period of time in a manner that the material engages the palm of the user's hand underneath the outlet.

19. A method as claimed in claim 18 wherein the first sensor comprises a fingerprint reader and the method of includes reading a fingerprint of the user's thumb placed on or proximate the fingerprint reader.

20. A method as claimed in claim 19 including recording the fingerprint read by the thumb reader.

21. A method as claimed in claim 20 including determining whether a user's hand remains underneath the outlet as sensed by the second sensor for a period of time during which that the material was dispensed.

22. A dispenser having an outer housing with a forward surface extending upwardly from a leading lower edge and a lower surface extending downwardly and rearwardly from the leading lower edge, an outlet on the lower surface disposed to direct fluid downwardly onto an upwardly directed palm of a user's hand placed below the lower surface;

a first sensor located on the forward surface relative the outlet at a position permitting sensing of a thumb of the user's hand extending upwardly from the palm, a dispensing mechanism to dispense material from the outlet when the dispensing mechanism is activated, a control mechanism to activate the dispensing mechanism to dispense fluid when the first sensor senses the thumb.

23. A dispenser as claimed in claim 22 including a second sensor on the lower surface to sense whether a user's palm is underneath the outlet, the control mechanism activating the dispensing mechanism to dispense fluid when the first sensor senses a thumb of the user and the second sensor senses a user's palm underneath the outlet.

* * * * *